US008727953B2

(12) United States Patent
Drechsler

(10) Patent No.: US 8,727,953 B2
(45) Date of Patent: May 20, 2014

(54) DYNAMIC WEIGHT LIFTING MACHINE

(76) Inventor: Arthur J Drechsler, Flushing, NY (US)

( * ) Notice: Subject to any disclaimer, the term of this patent is extended or adjusted under 35 U.S.C. 154(b) by 238 days.

(21) Appl. No.: 13/065,783

(22) Filed: Mar. 30, 2011

(65) Prior Publication Data

US 2012/0252640 A1 Oct. 4, 2012

(51) Int. Cl.
*A63B 21/00* (2006.01)

(52) U.S. Cl.
USPC ..... 482/104; 482/106; 482/135; 482/98

(58) Field of Classification Search
USPC ..... 482/104, 106, 135, 98
See application file for complete search history.

(56) References Cited

U.S. PATENT DOCUMENTS 7,374,516 B2 * 5/2008 Lundquist ..... 482/104

* cited by examiner

*Primary Examiner* — Jerome w Donnelly
(74) *Attorney, Agent, or Firm* — Tod R. Nissle, P.C.

(57) ABSTRACT

An exercise system utilizes exercise apparatus having at least two operative positions, a first operative position with a base fixedly contacting a floor, and a second operative position with the base spaced apart from the floor and horizontally moveable over the floor in any desired direction of travel. When a barbell is mounted at rest on the exercise apparatus the apparatus is in the first operative position. When the barbell is disengaged from the at rest position, the exercise apparatus moves to the second operative position.

6 Claims, 4 Drawing Sheets

DYNAMIC WEIGHT LIFTING MACHINE

This invention relates to weight lifting apparatus and methods.

More particularly, the invention relates to an improved weight lifting machine and apparatus which facilitates the proper positioning of weights with respect to the body of an individual during an exercise and which reduces the risk of injury to the individual.

The motivation to provide weight lifting equipment and methodology which minimizes the risk of injury to an individual has long existed. As a result, numerous exercise equipment apparatus have been produced along with multitudes of exercise routines, and such apparatus and routines have been redesigned and analyzed over and over and over again for many decades.

Accordingly, it would be highly desirable to provide an improved exercise apparatus and methodology to reduce the risk of injury to an individual and to facilitate the use of proper technique in carrying out an exercise.

Therefore it is a principal object of the invention to provide an improved exercise apparatus and methodology.

This and other, further and more specific objects of the invention will be apparent to those skilled in the art from the following detailed description thereof, taken in conjunction with the drawings, in which.

Briefly, in accordance with the invention, I provide an improved method in which an individual dynamically positions a weight during an exercise to facilitate proper exercise technique and reduce the risk of injury. The improved method comprises the step in which the individual provides an exercise apparatus. The exercise apparatus includes a base having at least two operative positions, a first operative position with the base fixedly contacting a floor, and a second operative position with the base spaced apart from the floor and horizontally movable over the floor in any desired direction of travel. The exercise apparatus also includes a pair of spaced apart vertically oriented legs each have a lower portion attached to the base and an upper portion; at least one fixed support on the upper portion of at least one of the legs; at least one sleeve slidably mounted on at least one of the legs; a barbell extending between the vertically oriented legs and attached to the sleeve such that the barbell and sleeve slidably simultaneously move along a leg; and, stabilizing apparatus mounted on the barbell and moveable between at least two operative positions, a primary operative position with the stabilizing apparatus engaging the fixed support to secure the barbell in fixed position on the legs such that the fixed support supports the weight of the barbell, and a secondary operative position with the stabilizing apparatus disengaged from the fixed support (1) to permit the sleeve and the barbell to slide up and down along the legs, and (2) such that the weight of the barbell is not supported by the fixed support. The base is in the first operative position when the stabilizing apparatus is in the primary operative position; and, is in the second operative position when the stabilizing apparatus is in the secondary operative position. The method also comprises the steps of placing the stabilizing apparatus in the primary operative position such that the base is in the first operative position and the exercise apparatus is at an initial location on the floor; moving to a position (i.e., the individual positions himself) between the legs beneath the barbell; grasping (i.e., the individual grasps) the barbell and moving the stabilizing apparatus to the secondary operative position such that the base is in the second operative position; and, performing (i.e., the individual performs) an exercise while sliding the sleeve (i.e., the individual slides the sleeve) and the barbell along said leg, and moving the exercise apparatus (i.e., the individual moves the exercise apparatus with his hands on the barbell) from said initial position on said floor to another position on said floor.

Figure 1:
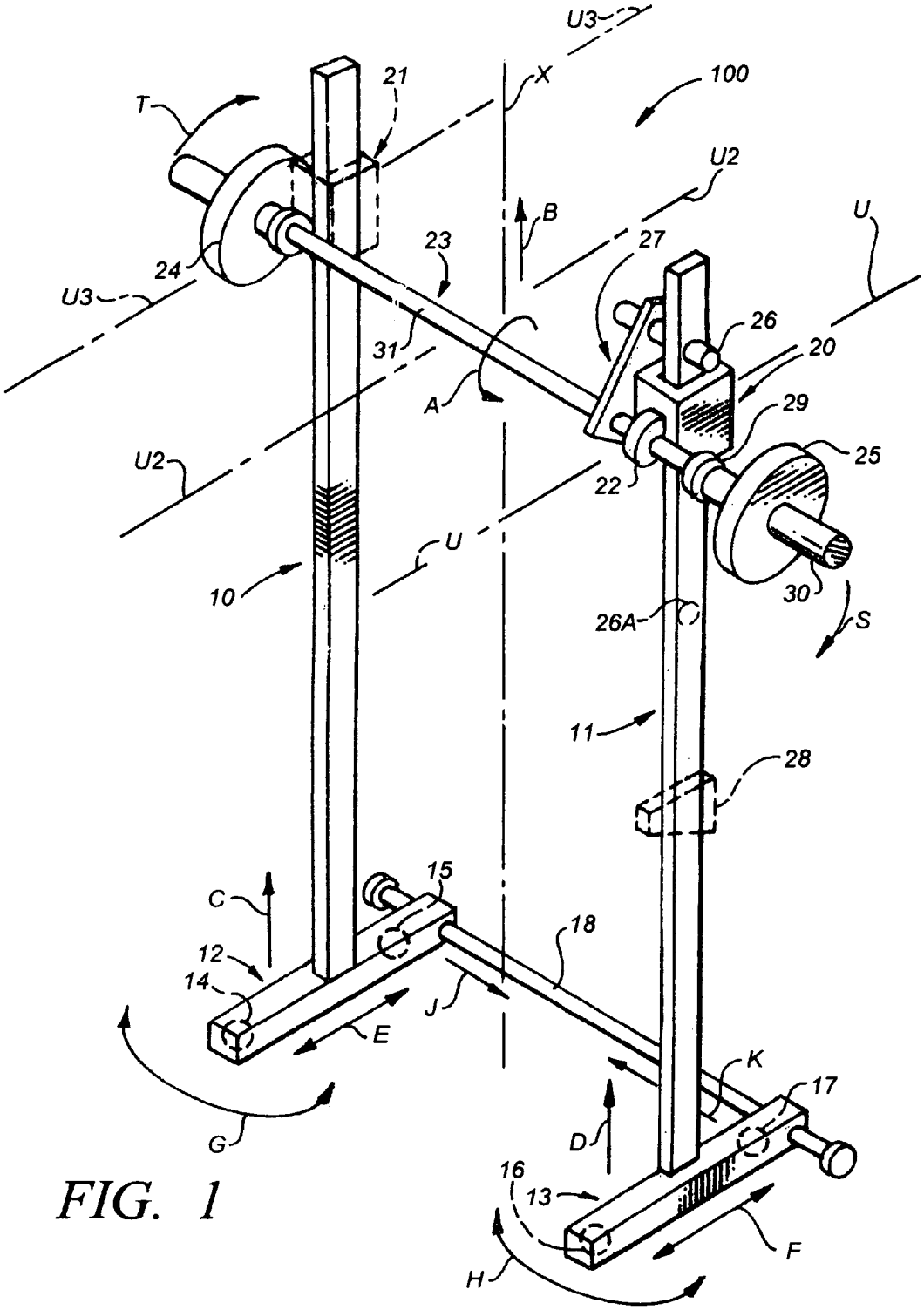
FIG. 1 is a perspective view illustrating exercise apparatus constructed in accordance with the principles of the invention.

Turning now to the drawings, which depict the presently preferred embodiments of the invention for the purpose of illustration thereof, and not by way of limitation of the invention, and in which like reference characters refer to corresponding elements throughout the several views, FIG. 1 illustrates an exercise apparatus which is constructed in accordance with the invention, is generally indicated by reference character 100, and includes a base including a pair of spaced apart feet 12 and 13. Foot 12 includes compressive elements comprising a pair of spring loaded spherical bearings 14 and 15. Foot 13 includes compressive elements comprising a pair of spring loaded bearings 16 and 17. When bearings 14 to 17 are deployed they roll freely over the floor and permit the exercise apparatus 100 to move or rotate in any desired direction. One important advantage of the invention is that it obviates the need to provide two pair of uprights or legs; one pair for pins to position or stow the barbell and another pair of uprights for the slidable sleeve(s) 20 to slide along while performing an exercise. Instead, in the apparatus of the invention, a single leg 11 can perform both functions. Another important advantage of the apparatus is the compressive elements such that when the bearings 14 to 17 are downwardly deployed in the manner described below, and the apparatus 100 is free to roll over the floor 41 in any direction permitting users to experience freedom of movement similar to that experienced with free weights. When this feature is combined with the use of stop 28, a spotting function is generated that moves continuously with the user in any direction. Since the apparatus 100 moves continuously with the user, if the user loses control and the barbell must fall toward the floor, stop 28 is there to "catch" the barbell 23. This feature of the invention is particularly important when a user is performing a bench press. If a user loses control of a barbell during a bench press, the barbell can fall on the user's chest. Each year several people die in such accidents. When apparatus 100 is utilized with a stop 28, stop 28 is continuously positioned between the barbell and a user's body. Still another important advantage of the apparatus 100 is that the freedom of movement permitted by the apparatus helps compensate and accommodate anatomical differences like different leg and arm lengths, or spine curvature to one side or the other. Exercise machines like the Smith machine assume legs and arms are the same length and can produce undue stress on one part of body.

Elongate rod 18 slidably extends through each foot 12 and 13 such that foot 12 can slide along rod 18 in the direction of arrow J toward foot 13, and such that foot 13 can slide along rod 18 in the direction of arrow K toward foot 12. Foot 12 can, of course, also slide along rod 18 in a direction opposite that of arrow J, and foot 13 can also slide along rod 18 in a direction opposite that of arrow K.

The lower portion of vertically oriented leg 10 includes a lower end fixedly secured to foot 12. The lower portion of vertically oriented leg 11 includes a lower end fixedly secured to foot 13.

Barbell 23 includes bar 31. A collar 29 and rotatable sleeve 30 are mounted on each end of bar 31. Rotatable sleeve 30 and collar 29 are, in conventional fashion, free to rotate about bar 31.

Sleeve 20 is slidably mounted on the upper portion of leg 11. Barbell 23 is fixedly secured to sleeve 20 by control member 22 such that sleeve 20 and barbell 23 simultaneously slide along leg 11. Barbell 23 is, however, free to rotate in control member 22. An equivalent slidable sleeve 21 can also, if desired, be mounted on the upper portion of leg 10; and, a control member comparable to control member 22 can be used to fixedly secure barbell 23 to sleeve 21. In an alternate embodiment of the invention, control member 22 is not utilized and, instead, collar 29 is fixedly secured to sleeve 20. In FIG. 1, sleeves 20 and 21 are slidably mounted on the exterior of legs 10 and 11. As would be appreciated by those of skill in the art, each sleeve can, if legs 10 and 11 are hollow, be slidably mounted on the interior of a leg 10, 11, and can include a pin or other portion which extends from barbell 23 to the interior of leg 10, 11 (and to the sleeve on the interior of the leg) via a longitudinal slot formed along the length of the leg. Consequently, as used herein, the term sleeve applies to any member which is shaped and dimensioned to engage barbell 23 and to slide along a leg 10 and 11 simultaneously with barbell 23. The shape and dimension of a leg 10, 11 can similarly be varied as desired to engage a sleeve to permit the sleeve and barbell 23 to slide up and down along the leg.

In another embodiment of the invention, control member 22 is pivotally attached to sleeve 20 (and the comparable member attached to sleeve 21 is pivotally attached to sleeve 21) so that control member 22, and therefore bar 31, can pivot or rotate to a limited degree about an axis U (FIG. 1) that is parallel to foot 13 and that passes through control member 22 and sleeve 20. This permits bar 31 to be tilted in the manner indicated by arrows S and T (or in directions opposite arrows S and T) with respect to a horizontally oriented plane. As would be appreciated by those of skill in the art, arrows S and T lie in a common vertically oriented plane.

If, in addition to sleeve 20 and control member 22, sleeve 21 is utilized with a control member comparable to control member 22 attached to sleeve 21, then, in order for bar 31 to pivot about an axis U2, the control member attached to sleeve 21 must be able to rotate about an axis U3. Consequently, if in this configuration one sleeve 20, 21 is at a different elevation than the other sleeve, the control members 22 attached to sleeves 20 and 21 can rotate to permit bar 31 (and therefore barbell 23) to tilt in the manner indicated by arrows S and T with respect to a horizontal plane. The ability of bar 31 tilt away from a horizontal plane enables an individual to more readily compensate for differences in body make-up, including for instance a situation in which one of the individual's legs is longer than the other. Axes U, U2, and U3 are parallel.

A safety stop, indicated by dashed lines 28, can be fixedly attached to leg 11 or 10 to "catch" barbell 23 is a user loses control of barbell 23 or must lower barbell 23 toward the ground.

The apparatus of FIG. 1 includes a fixed support member in the form of a pin 26. The fixed support member can be shaped and dimensioned as desired. The fixed support member can be permanently attached to a leg 10, 11 or can, as is the case with pin 26 in FIG. 1, be slidably inserted through an aperture in leg 11 such that the member 26 can be removed and inserted in another desired aperture 26A (FIG. 1) formed along leg 11 or can otherwise be removed and placed at another desired location along leg 11.

The apparatus of FIG. 1 includes a stabilizing apparatus in the form of a bracket 27 that is fixedly mounted on barbell 23. The upper end of bracket 27 includes a slot that removably engages pin 26. When barbell 23 is grasped and rotated in the direction of arrow A, bracket 27 pivots simultaneously with barbell 23 in the direction of arrow A such that the slot in bracket 27 pivots off pin 26. When bracket 27 pivots off pin 26, barbell 23 is free to slide up and down along legs 10 and 11. Barbell 23 can slide only a short distance in the upward direction indicated by arrow B before sleeve 20 contacts pin 26. Barbell 23 can slide a greater distance in the downward direction opposite that of arrow B. In an alternate embodiment of the invention, bracket 27 is mounted on bar 31 on the opposite side of leg 11 and adjacent collar 29. If desired, a bracket comparable to bracket 27 can be included in the apparatus to be used adjacent in conjunction with sleeve 21 in the same manner that bracket 27 is utilized adjacent sleeve 20.

Figure 2:
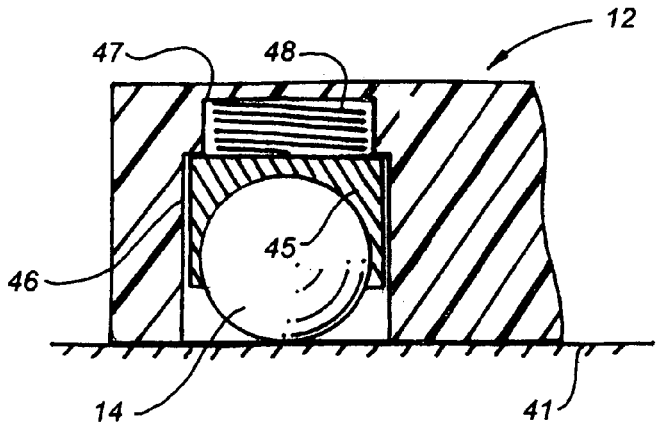
FIG. 2 is a partial section view of the apparatus of FIG. 1 illustrating additional construction details thereof.
Figure 3:
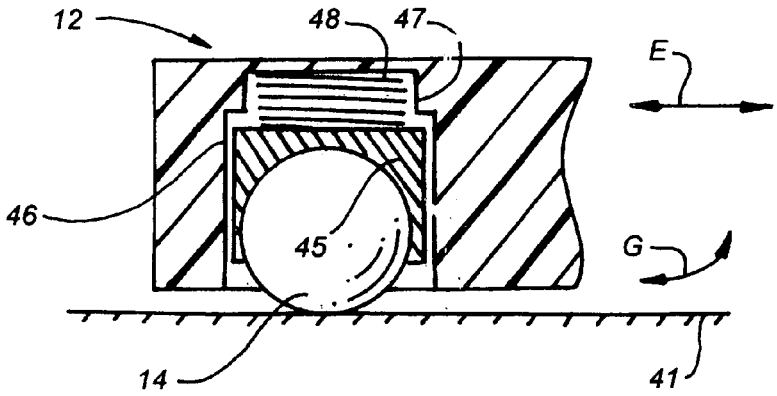
FIG. 3 is a partial section view of the apparatus of FIG. 2 illustrating the mode of operation thereof.

When bracket 27 engages pin 26 in the manner illustrated in FIG. 1, the weight of barbell 23 is borne by pin 26 and therefore base 12 and 13 and is sufficient to maintain the base 12, 13 in contact with the floor 41 in the manner illustrated in FIG. 2. This is the case because the weight of the barbell, in combination with the weight of the rest of apparatus 100, overcomes the combined expansive strength of the springs 48 operatively associated with bearings 14 to 17 and causes each bearing 14 to 17 to be pushed into it associated cylindrical aperture 46 in the manner illustrated in FIG. 2. When a bearing 14, along with its bushing-housing 43, is pushed into aperture 46, spring 48 is compressed into cylindrical aperture 47. On the other hand, when barbell 23 is rotated in the direction of arrow A to disengage bracket 27 from pin 26, the weight of barbell 23 (and any weights 24 and 25 on the barbell) is no longer borne by pin 26, in which case the combined expansive strength of the springs 28 operatively associated with each spherical bearing 14, 15, 16, 17 is sufficient to lift the apparatus upwardly in the direction of arrow B such that a portion of each spherical bearing 14 to 17 extends beneath base 12 or 13 in the manner illustrated in FIG. 3. When a portion of each spherical bearing 14 to 17 extends beneath base 12 or 13 in the manner illustrated in FIG. 3, the bearings 14 to 17 and apparatus 100 can be rolled over floor 41 in any desired horizontal direction including, without limitation, the directions indicated by arrows E. Apparatus 100 can also be pivoted about a vertical axis X in the manner indicated by arrows G and H in FIGS. 1 and 3. Since barbell 23 is a part of apparatus 100, barbell can be similarly moved in any desired horizontal direction and can be pivoted about a vertical axis X. If it is desired to fix apparatus 100 at a particular location on floor 41, barbell 23 is lifted to the position illustrated in FIG. 1 and is rotated in a direction opposite that of arrow A to re-engage the slot in bracket 27 with pin 26. As soon as this is accomplished and pin 26, and therefore apparatus 100, is bearing the weight of barbell 23, springs 48 are overcome and base 12, 13 is downwardly displaced back into contact with the floor 41. The weight of barbell 23 and of apparatus 100 tends to generate frictional forces which make it difficult to slide base 12, 13 over floor 41 when base 12, 13 contacts floor 41 in the manner illustrated in FIG. 2.

Figure 4:
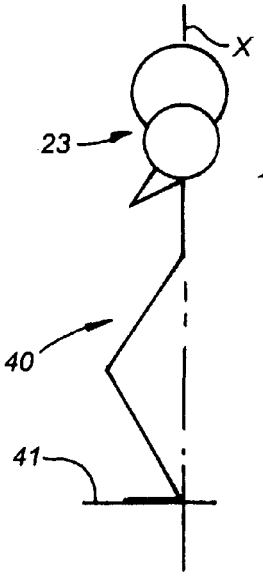
FIG. 4 is a side elevation view illustrating an individual conducting an exercise with a barbell which moves along fixed vertically oriented legs.
Figure 5:
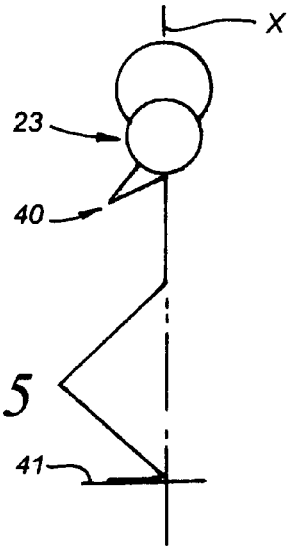
FIG. 5 is a side elevation view further illustrating an individual conducting an exercise with a barbell which moves along fixed vertically oriented legs.
Figure 6:
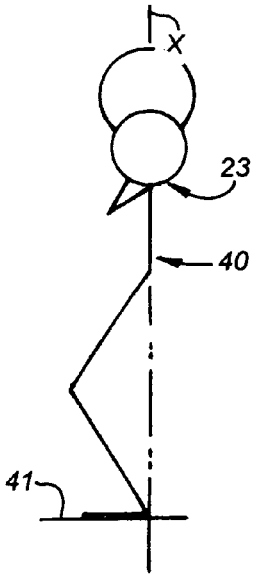
FIG. 6 is a side elevation view illustrating an individual conducting an exercise with the apparatus of FIG. 1.

In FIGS. 4 and 5, a comparable apparatus is utilized which is similar to apparatus 100 but which maintains a fixed position on floor 41. The comparable apparatus will not move, regardless of the position of the body of an individual 40. The immobility of comparable apparatus increases the risk of injury, particularly with heavier weights, because the optimal position of barbell 23 varies with respect to an individual's build and with respect to the position of the individual at varying points during an exercise. In contrast, as is described below with respect to FIGS. 6 and 7, the apparatus 100 of the invention is readily moved to optimal positions during an exercise by an individual.

The apparatus of FIG. 1 also permits a more compact design since the collar 20, bracket 27 and catch 28 are on a single upright 11 and follow the user around. As a result, a larger fixed exercise cage or apparatus is not required.

In use, the apparatus 100 of FIG. 1 is provided. Bracket 27 is in a primary operative position engaging pin 26. The base 12, 13 is in a first operative position with the base 12, 13 fixedly contacting the floor 41 in the manner illustrated in FIG. 2. The weight of apparatus 100, which includes barbell 23, is sufficient to overcome springs 48 and force bearings 14 to 17 completely into their respective apertures 46. The construction for the spring 48, apertures 46 and 47, etc. for each bearing 15 to 17 is equivalent to the construction illustrated in FIGS. 2 and 3 for bearing 14.

Figure 7:
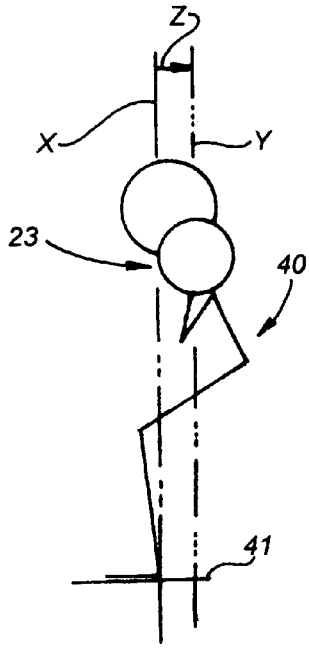
FIG. 7 is a side elevation view further illustrating an individual conducting an exercise with the apparatus of FIG. 1; AND, FIG. 8 is a perspective view illustrating an alternate embodiment of the invention.

An individual 40 stands between legs 10 and 11 beneath barbell 23, grasps barbell 23, and pivots it in the direction of arrow A to disengage bracket 27 from pin 26 and, consequently, to move bracket 27 from a primary operative position to a secondary operative position. When bracket 27 is in the secondary operative position, pin 26 (and base, 12, 13) no longer bears the weight of barbell 23. This permits springs 48 to downwardly displace each bearing 14 to 17 to a position equivalent to that shown in FIG. 3. When bearings 14 to 17 are in the position illustrated in FIG. 3, base 12, 13 and legs 10, 11 are lifted off floor 41, which places base 12, 13 in a second operative position in which apparatus 100 can, due to the rotatability of bearings 14 to 17, move freely over floor 41 in any desired linear or rotational horizontally oriented direction. Even though the feet of the individual 40 may not, as is illustrated in FIGS. 4 to 7, move with respect to the original vertical axis X at which the individual is located when the individual first positions himself or herself between legs 10 and 11, the individual can utilize his hands to move freely barbell 23 (and therefore the remainder of apparatus 100) over floor 41. Such movement of the barbell 23 is advantageous because, as is illustrated in FIG. 7, during the performance of a squat the optimal position of the barbell 23 may no longer be along the original vertical axis X, but may have moved to another vertical axis Y which is a distance, indicated by arrow Z, from the original vertical axis X. In comparison, in the squat being performed in FIG. 5, the barbell must continue to move along axis X because the legs 10 and 11 of the comparable apparatus discussed above are in fixed position and cannot move during performance of the exercise.

As would be appreciated by those of skill in the art, the apparatus of FIG. 1 can be utilized for exercises other than squats. For example, an individual can position a bench between legs 10 and 11 and beneath barbell 23 to perform a bench press. The individual lies face up and, after disengaging bracket 27 from a pin 26, moves the barbell 23 up and down to perform a bench press. In the event apparatus 100 is used to perform a bench press, pin 26 and stop 28 would be lowered on leg 11 to positions appropriate for performing a bench press.

Stop 28 can be shaped and dimensioned to contact and prevent the downward movement of sleeve 20, and/or can be shaped and dimensioned to contact and prevent the downward movement of barbell 23.

Figure 8:
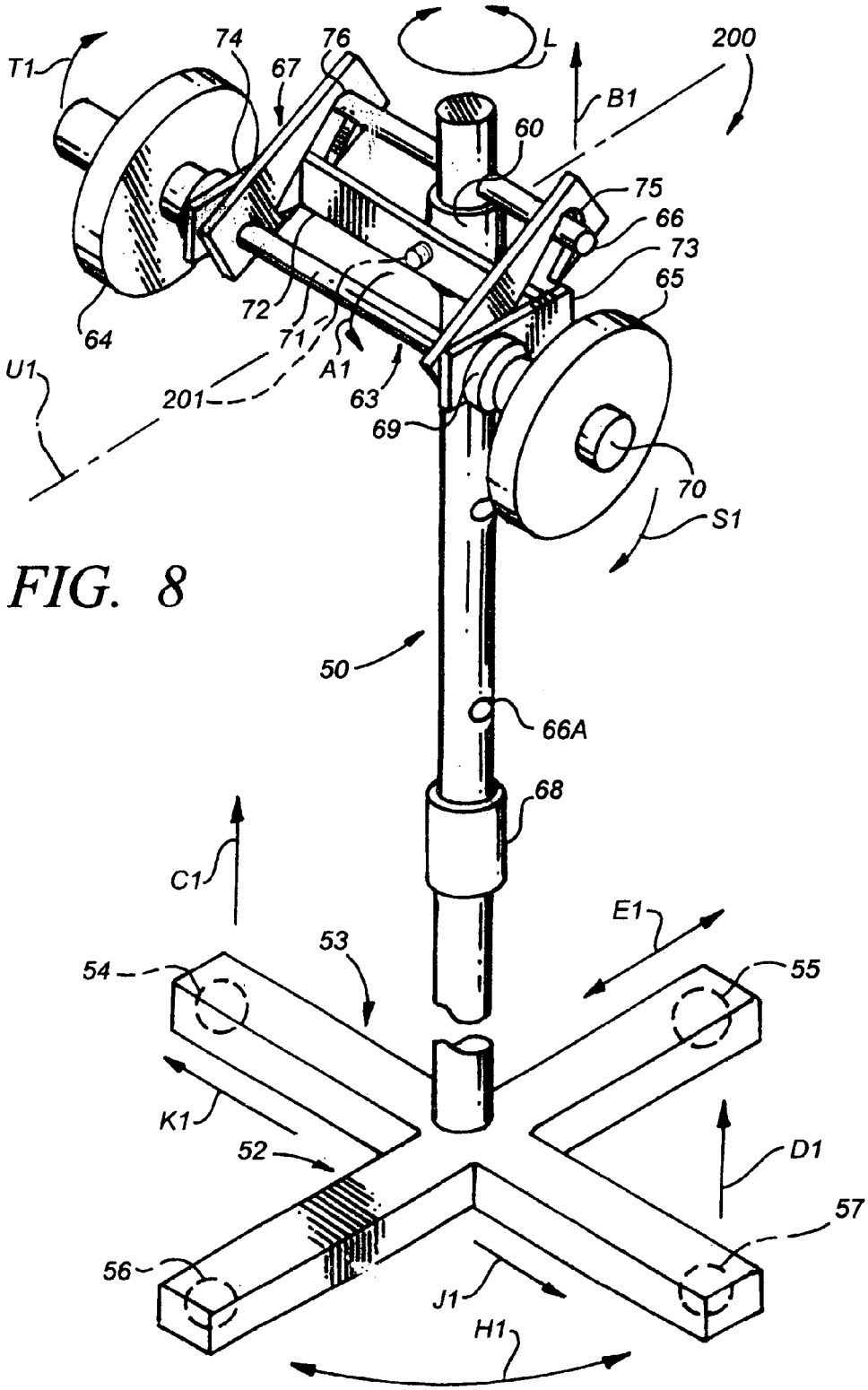

FIG. 8 illustrates an exercise apparatus which is constructed in accordance with an alternate embodiment of the invention, is generally indicated by reference character 200, and includes a base including a pair of spaced apart feet 52 and 53. The base includes compressive elements comprising four spring loaded spherical bearings 54, 55, 56, 57 which when deployed roll over the floor and permit the exercise apparatus 200 to move or rotate in any desired direction. The base can have any desired shape and dimension as long as it has at least three floor engaging spherical bearings.

The lower portion of vertically oriented leg 50 includes a lower end fixedly secured to the base.

Dumbbell 63 includes handle 71. A collar 69 and rotatable sleeve 70 are mounted on each end of handle 71. Sleeve 70 and collar 69 are, in conventional fashion, free to rotate about handle 71.

Slidable sleeve 60 is slidably mounted on the upper portion of leg 50. Dumbbell 63 is fixedly secured to sleeve 60 by member 72 such that sleeve 60 and dumbbell 63 simultaneously slide upwardly or downwardly along leg 50. Handle 71 rotatably extends through parallel spaced apart members 73 and 74. Each member 73, 74 is fixedly connected to an end of rectangular member 72. Dumbbell 63 can also, if desired, rotate about leg 50 simultaneously with sleeve 60 in the manner indicated by arrows L. In FIG. 8, sleeve 60 is slidably mounted on the exterior of leg 50. As would be appreciated by those of skill in the art, sleeve 60 can, if leg 50 is hollow, be slidably mounted on the interior of leg 50, and can include a pin or other portion which extends from dumbbell 63 to the interior of leg 50 (and to the sleeve on the interior of the leg) via a longitudinal slot formed along the length of the leg 50. Consequently, as used herein, the term slidable sleeve applies to any member which is shaped and dimensioned to engage dumbbell 63 and to slide along leg 50 simultaneously with dumbbell 63. The shape and dimension of a leg 50 can similarly be varied as desired to engage a sleeve to permit the sleeve and dumbbell 63 to slide up and down along the leg.

One or more safety stops 68 can be fixedly or adjustably attached to leg 50 at desired locations along leg 50 to "catch" dumbbell 63 if a user loses control of dumbbell 63 or must lower dumbbell 63 toward the ground.

The apparatus of FIG. 8 includes a fixed support member in the form of a pin 66. The fixed support member 66 can be shaped and dimensioned as desired. The fixed support member can be permanently attached to leg 50 or can, as is the case with pin 66 in FIG. 8, be slidably inserted through an aperture in leg 50 such that the member 66 can be removed and inserted in another desired aperture 66A (FIG. 8) formed along leg 50 or can otherwise be removed and placed at another desired location along leg 50.

The apparatus of FIG. 8 includes a stabilizing apparatus in the form of a bracket assembly 67 that is fixedly mounted on rod 71 of dumbbell 63. The shape and dimension of the brackets in assembly 67 is generally comparable to that of bracket 27 in FIG. 1, except that the brackets in assembly 67 are normally longer that bracket 27. The upper ends of bracket assembly 67 include slots 75 and 76 that removably engage pin 66. When handle 71 of dumbbell 63 is grasped, upwardly displaced in the direction of arrow B1, and rotated in the direction of arrow A1, bracket 27 pivots simultaneously with dumbbell 63 in the direction of arrow A such that the slots 75 and 76 in bracket 67 lift and pivot off pin 66. When bracket 67 lifts and pivots off pin 66, dumbbell 63 is free to slide up and down along leg 50. Dumbbell 63 can slide only a short distance in the upward direction indicated by arrow B1 before sleeve 60 contacts pin 66. Dumbbell 63 can slide a greater distance in the downward direction opposite that of arrow B1.

When bracket 67 engages pin 66 in the manner illustrated in FIG. 8, the weight of dumbbell 63 is borne by pin 66 and therefore base 12 and 13 and is sufficient to maintain the base 12, 13 in contact with the floor 41 in the manner illustrated in FIG. 2 with respect to 14. The construction of bearings 54 to 57 is identical to that of roller 14 for purposes of this discussion, although, as would be appreciated by those of skill in the art, the construction of the compressive elements 14, 54 to 57 can vary as desired as long as the desired functions are achieved. When dumbbell 63 is mounted on pin 66 in the manner illustrated in FIG. 8, the weight of the dumbbell, in combination with the weight of the rest of apparatus 200, overcomes the combined expansive strength of the springs 48 operatively associated with bearings 54 to 57 and causes each bearing 54 to 57 to be pushed into its associated cylindrical aperture 46 in the manner illustrated in FIG. 2. When a bearing 54 to 57, along with its bushing-housing 43, is pushed into aperture 46, spring 48 is compressed into cylindrical aperture 47. On the other hand, when dumbbell 63 is lifted in the direction of arrow B1 and rotated in the direction of arrow A1 to disengage bracket 67 from pin 66, the weight of dumbbell 63 (and any weights 64 and 65 on the dumbbell) is no longer borne by pin 66, in which case the combined expansive strength of the springs 48 operatively associated with each spherical bearing 54 to 57 is sufficient to lift the apparatus 200 upwardly off floor 41 in the direction of arrows B1, Cl, and D1 such that a portion of each spherical bearing 54 to 57 extends beneath feet 52, 53 in a manner identical to that illustrated in FIG. 3 for roller 14. When a portion of each spherical bearing 54 to 57 extends beneath feet 52 or 53 in the manner illustrated in FIG. 3, the bearings 54 to 57 and apparatus 200 can be rolled over floor 41 in any desired horizontal direction including, without limitation, the directions indicated by arrows E1, K1, and J1. Apparatus 200 can also be pivoted about a vertical axis in the manner indicated by arrows H1 in FIG. 8. Since dumbbell 63 is a part of apparatus 200, dumbbell 63 can be similarly moved in any desired horizontal direction and can be pivoted about a vertical axis X. If it is desired to fix apparatus 200 at a particular location on floor 41, dumbbell 63 is stowed on pin 66 in the position illustrated in FIG. 8. As soon as this is accomplished and pin 66, and therefore apparatus 200, is bearing the weight of dumbbell 63, springs 48 are overcome and legs 52 and 53 are downwardly displaced back into contact with the floor 41. The weight of dumbbell 63 and of apparatus 200 tends to generate frictional forces which make it difficult to slide legs 52, 53 over floor 41 when legs 52, 53 contact floor 41 in the manner illustrated in FIG. 2.

In another embodiment of the invention, member 72 is pivotally secured to sleeve 60 by a pin 201 (FIG. 8) that extends through member 72. When an individual grasps handle 71, manually upwardly lifts dumbbell 63 in the direction of arrow B1, and manually rotates handle 71 in the manner of arrow A1 to disengage bracket assembly 67 from pin 66, then member 72, and therefore dumbbell 63, is free to pivot about pin 201 (and horizontally oriented axis U1 extending through pin 201) in the manner indicated by arrows S1 and T1, and is free to pivot about pin 201 and axis U1 in directions opposite those indicated by arrows S1 and T1.

In use, the apparatus 200 of FIG. 8 is provided. Bracket 67 is in a primary operative position engaging pin 66 in the manner illustrated in FIG. 8. The legs 52, 53 are in a first operative position with the legs 52, 53 fixedly contacting the floor 41 in the manner illustrated in FIG. 2. The weight of apparatus 200, which includes dumbbell 23, is sufficient to overcome springs 48 and force bearings 54 to 57 completely into their respective apertures 46. The construction for the spring 48, apertures 46 and 47, etc. for each bearing 54 to 57 is, as noted, equivalent to the construction illustrated in FIGS. 2 and 3 for bearing 14.

An individual 40 stands adjacent leg 50, grasps rod 71 with one hand, lifts dumbbell in the direction of arrow B1, and pivots dumbbell in the direction of arrow A1 to disengage bracket 67 from pin 66, and, consequently, to move bracket 67 from a primary operative position to a secondary operative position. When bracket 67 is in the secondary operative position, pin 66 (and legs 52, 53) no longer bears the weight of dumbbell 63. This permits springs 48 to downwardly displace each bearing 54 to 57 to a position equivalent to that shown in FIG. 3. When bearings 54 to 57 are in the position illustrated in FIG. 3, legs 52 and 53 are lifted off floor 50, which places base legs 52 and 53 and apparatus 200 in a second operative position in which apparatus 200 can, due to the multi-directional rotatability of bearings 54 to 57, move freely over floor 41 in any desired linear or rotational horizontally oriented direction. The individual can utilize the hand grasping dumbbell 63 to move freely dumbbell 63 (and therefore the remainder of apparatus 200) over floor 41.

Stop 68 can be shaped and dimensioned to contact and prevent the downward movement of sleeve 60, and/or can be shaped and dimensioned to contact and prevent the downward movement of dumbbell 63.

One principal feature of the apparatus of the invention is the ability to relatively freely lift a barbell or dumbbell and to move the barbell and dumbbell in a variety of directions while still at the same time during such movement maintaining a safety stop 28 or 68 in position to catch the barbell or dumbbell if an individual finds it necessary to lower the barbell or dumbbell to the safety stop.

Having described the invention and presently preferred embodiments and the best modes thereof in such terms as to enable one of skill in the art to make and use the invention,

I claim:

1. A method in which an individual dynamically positions a weight during an exercise to facilitate proper exercise technique and reduce the risk of injury, comprising the steps in which the individual (a) provides an exercise apparatus including (i) a base having at least two operative positions, a first operative position with said base fixedly contacting a floor, and a second operative position with said base spaced upwardly apart from said floor, (ii) a pair of spaced apart vertically oriented legs each having a lower portion attached to said base and an upper portion, (iii) at least one fixed support on said upper portion of at least one of said legs, (iv) at least one sleeve slidably mounted on at least one of said legs, (v) a barbell extending between said vertically oriented legs and attached to said sleeve such that said barbell and said sleeve simultaneously slidably move along said one of said legs, (vi) stabilizing apparatus mounted on said barbell and moveable between at least two operative positions, a primary operative position with said stabilizing apparatus engaging said fixed support to secure said barbell in fixed position on said legs such that said fixed support supports the weight of said barbell, and a secondary operative position with said stabilizing apparatus disengaged from said fixed support (1) to permit said sleeve and said barbell to slide up and down along said legs, and (2) such that the weight of said barbell is not supported by said fixed support, and (vii) a plurality of spring loaded roller units (14, 48) having at least two operative positions, a stowed operative position when said barbell is in said primary operative position, said base being in said first operative position when said roller units are in said stowed operative position, and a deployed operative position when said barbell is in said secondary operative position, said roller units, when in said deployed operative position, lifting said base upwardly off said floor to said second operative position and permitting said base and said exercise apparatus to move freely over said floor in any desired direction of travel, said roller units, when in said stowed operative position, permitting said base to contact the floor in said first operative position;

(b) places said stabilizing apparatus in said primary operative position such that (i) said base is in said first operative position, (ii) said roller units are in said stowed operative position, and (iii) said exercise apparatus is at an initial location on said floor;

(c) moves between said legs beneath said barbell;

(d) grasps said barbell and moves said stabilizing apparatus to said secondary operative position such that said roller units (i) displace said base from said first operative position to said second operative position and (ii) permit said apparatus to be freely moved over said floor in any desired direction;

(e) performs an exercise while (i) sliding said sleeve and said barbell along said leg, (ii) moving said exercise apparatus from said initial position on said floor to another position on said floor.

2. A method in which an individual dynamically positions a weight during an exercise to facilitate proper exercise technique and reduce the risk of injury, comprising the steps in which the individual (a) provides an exercise apparatus including (i) a base having at least two operative positions, a first operative position with said base fixedly contacting a floor, and a second operative position with said base spaced upwardly apart from said floor, (ii) at least one vertically oriented leg have a lower portion attached to said base and an upper portion, (iii) at least one fixed support on said upper portion of said leg, (iv) at least one sleeve slidably mounted on at least one of said legs, (v) a dumbbell attached to said sleeve such that said barbell and said sleeve simultaneously slidably move along said one of said legs, (vi) stabilizing apparatus mounted on said barbell and moveable between at least two operative positions, a primary operative position with said stabilizing apparatus engaging said fixed support to secure said dumbbell in fixed position on said leg such that said fixed support supports the weight of said dumbbell, and a secondary operative position with said stabilizing apparatus disengaged from said fixed support (1) to permit said sleeve and said dumbbell to slide up and down along said leg, and (2) such that the weight of said dumbbell is not supported by said fixed support;

(vii) a plurality of spring loaded roller units (14, 48) having at least two operative positions, a stowed operative position when said barbell is in said primary operative position, said base being in said first operative position when said roller units are in said stowed operative position, and a deployed operative position when said barbell is in said secondary operative position, said roller units, when in said deployed operative position lifting said base upwardly off said floor to said second operative position and permitting said base and said exercise apparatus to move freely over said floor in any desired direction of travel, said roller units, when in said stowed operative position, permitting said base to contact the floor in said first operative position;

(b) places said stabilizing apparatus in said primary operative position such that (i) said base is in said first operative position, (ii) said roller units are in said stowed operative position, and (iii) said exercise apparatus is at an initial location on said floor;

(c) moves adjacent said leg;

(d) grasps said dumbbell with one hand and moves said stabilizing apparatus to said secondary operative position such that said roller units (i) displace said base from said first operative position to said second operative position, and (ii) permit said apparatus to be freely moved over said floor in any desired direction;

(e) performs an exercise while (i) sliding said sleeve and said dumbbell along said leg, (ii) moving said exercise apparatus from said initial position on said floor to another position on said floor.

3. The method of claim 1 including a safety stop on said leg.

4. The method of claim 2 including a safety stop on said leg.

5. The method of claim 1 wherein the distance between said legs is slidably adjustable along at least one elongate rod (18).

6. The method of claim 2 wherein said dumbbell is pivotally attached to said sleeve to pivot about a generally horizontally oriented axis (U1).

* * * * *